US005587562A

United States Patent [19]

Sato

[11] Patent Number: 5,587,562

[45] Date of Patent: Dec. 24, 1996

[54] DIAPHRAGM FOR ELECTRO-DYNAMIC TYPE LOUDSPEAKERS

[75] Inventor: Masatoshi Sato, Tendo, Japan

[73] Assignees: Tohoku Pioneer Electronic Corporation, Yamagata-ken; Pioneer Electronic Corporation, Tokyo, both of Japan

[21] Appl. No.: 503,632

[22] Filed: Jul. 18, 1995

[30] Foreign Application Priority Data

Jul. 26, 1994 [JP] Japan ..... 6-174512

[51] Int. Cl.[6] ..... H04R 7/00

[52] U.S. Cl. ..... 181/167; 525/437; 528/295.5; 528/302

[58] Field of Search ..... 181/167; 525/437; 528/295.5, 302

[56] References Cited

U.S. PATENT DOCUMENTS 4,412,103 10/1983 Fujii ..... 524/449

*Primary Examiner*—Patricia A. Short
*Attorney, Agent, or Firm*—Morgan, Lewis and Bockius LLP

[57] ABSTRACT

A diaphragm used for a loudspeaker comprises polybutylene-terephthalate-polyester-elastomer. It has a flat audio spectrum property and excellent in internal loss, heat-resistance, light-resistance and water-resistance.

1 Claim, 3 Drawing Sheets

DIAPHRAGM FOR ELECTRO-DYNAMIC TYPE LOUDSPEAKERS

BACKGROUND OF THE INVENTION

1. Field of the Invention

The present invention relates a diaphragm such as a cone, a center-cap or the like for use in a loudspeaker.

2. Description of the Related Art

There is known an electro-dynamic type loudspeaker as shown in its sectional view of FIG. 1. Such an electro-dynamic type loudspeaker has a metal back-plate 1 to the center of which a cylindrical magnetizable pole piece 2 is attached and, a ring permanent magnet 3 is attached to the back-plate 1 at the periphery. A ring pole plate 4 is attached to the top of the magnet 3 and surrounds the tope of the pole piece 2 and thus forms a magnetic gap between the pole piece 2 and the pole plate 4. A voice coil bobbin 6 carrying a voice coil 5 is freely inserted to such a magnetic gap. The voice coil bobbin 6 is supported by a compliant dumper 7 having corrugations. The voice coil bobbin 7 is rigidly connected to the center of a cone 8. The cone 8 is provided with a center-cap 9 at the center of the cone 8. The opening periphery of the cone 8 is supported by an edge member 10 which is fixed by a gasket 12 to a rigid frame 11. Lead wires of the voice coil are electrically connected through twist lines 13 to terminals 14 on the side of the frame 11.

There are various diaphragms for the cone 8 for examples, a cone which heat-formed from a base fabric embracing a resin, a cone which heat-formed from a plastic or foamed plastic thin film, a cone which integrally formed with an edge member from the same material and so on. The material of the cone 8 is selected from a natural paper pulp, a synthesized paper pulp, polyimides (hereinafter referred to as PI), polyetherimides (hereinafter referred to as PEI), polyphenylene sulfide (hereinafter referred to as PPS) or the like.

Since the variety of human everyday living expands the places at which the loudspeakers are set up, the variation of performance and durability in the loudspeaker should be widened. For example, the temperature variation of the cabin of a motor vehicle is about −30 to +80 centigrade through one year and, particular its peak temperature may reach 120 centigrade on a dash board or rear-shelf tray exposed directly in a midsummer. Thus the on-vehicle loudspeaker is required in a high thermal resistance. Furthermore, the on-vehicle loudspeaker is also required to be durable against an ultra-violet ray since a deterioration of cone material occurs due to the irradiation of ultra-violet ray. Therefore, a cone material with a high thermal and light resistance is employed. To improve a water resistance of the cone in the on-vehicle loudspeaker, a cone coated with an acrylic resin or cone essentially made of polypropylene resin is employed.

In this way, it is very important to select materials on the thermal, light and water resistance in the designing for a cone of the on-vehicle loudspeaker since it is used under a severe environment in the motor vehicle cabin. Moreover, the sound quality of loudspeaker is demanded by the improvement of digital music source. Accordingly, a cone with a high performance is also demanded.

However, there is a problem in the thermal resistance that the resin diaphragm with a comparatively high internal loss damping objectionable internal vibrations has a low melting point the other resin diaphragm with a high melting point is solid, but its internal loss is insufficient to dampen the objectionable internal vibrations, so that it is difficult to flatten the middle and high ranges in the audio spectrum property of the loudspeaker.

SUMMARY OF THE INVENTION

Therefore, an object of the present invention is to provide a diaphragm used for a loudspeaker having a high internal loss and high heat-resistance.

A diaphragm used for a loudspeaker according to the present invention essentially comprises polybutylene-terephthalate-polyester-elastomer.

The present invention provides a diaphragm used for a loudspeaker having a high internal loss and high heat-resistance.

DETAILED DESCRIPTION OF THE PREFERRED EMBODIMENTS

The preferred embodiments according to the present invention will be described in detail with reference to the accompanying drawings.

Figure 2:
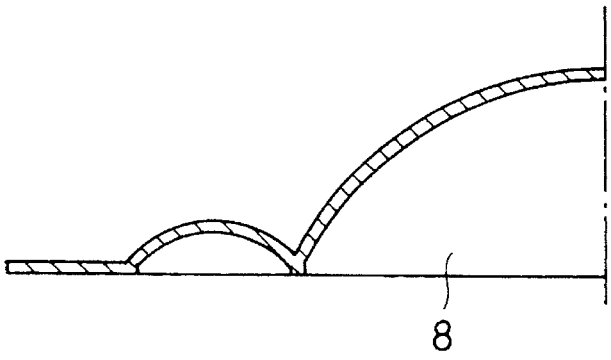
FIG. 2 is a partial sectional view showing a half of a diaphragm of dome in a dome type loudspeaker.

FIG. 2 is an enlarged partial sectional view showing an embodiment of a dome-shaped diaphragm 8. This diaphragm 8 is formed through a heat-press process from polybutylene-terephthalate-polyester-elastomer represented by formula 1 below,

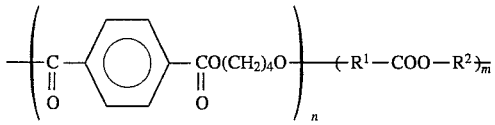

(1)

wherein $R^1$ denotes $C_{17}H_{34}$, $C_{17}H_{32}$, $C_{17}H_{31}OCOCH_3$ or $Cl_5C_{17}H_{29}$, $R^2$ denotes $C_4H_8$, $CH_2OC_4H_6$ or $CH_2$, and n and m individually denotes integers. Such an elastomer is resulted from copolymerization both of a polybutylene-terephthalate and a polyester including $R^1COOR^2$ chain. The polybutylene-terephthalate is resulted from condensation between terephthalic acid and 1,4-butanediol. The used polybutylene-terephthalate-polyester-elastomer is commercially available from Teijin limited as ELA4110 and ELA4130.

Figure 1:
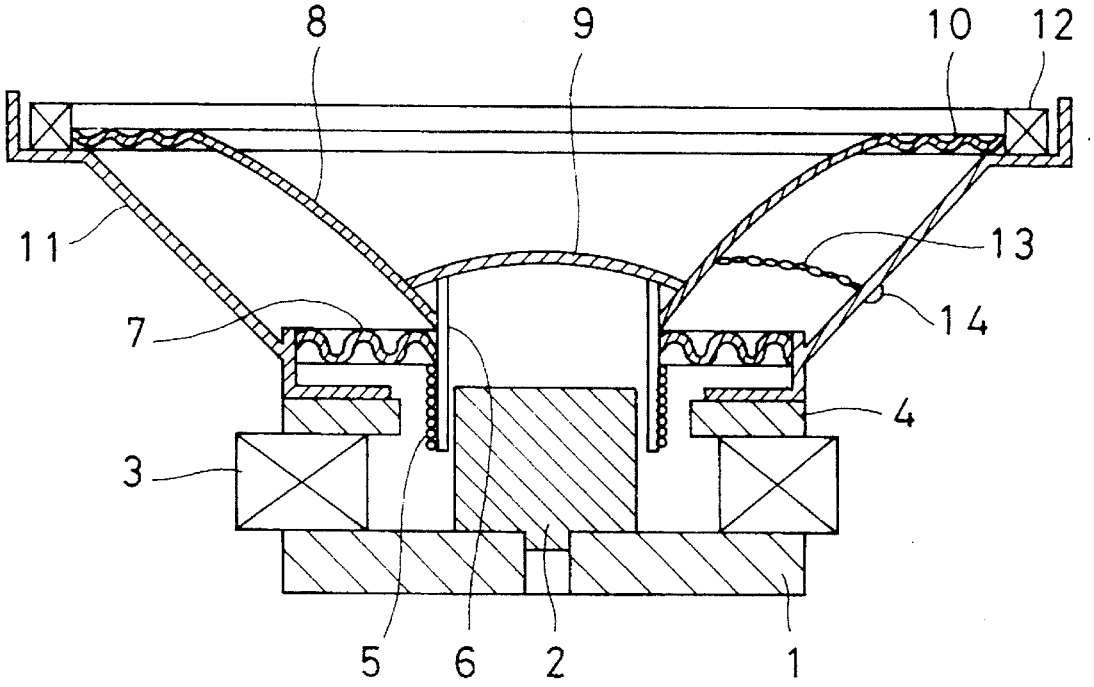
FIG. 1 is a sectional view showing a cone type loudspeaker.
Figure 3:
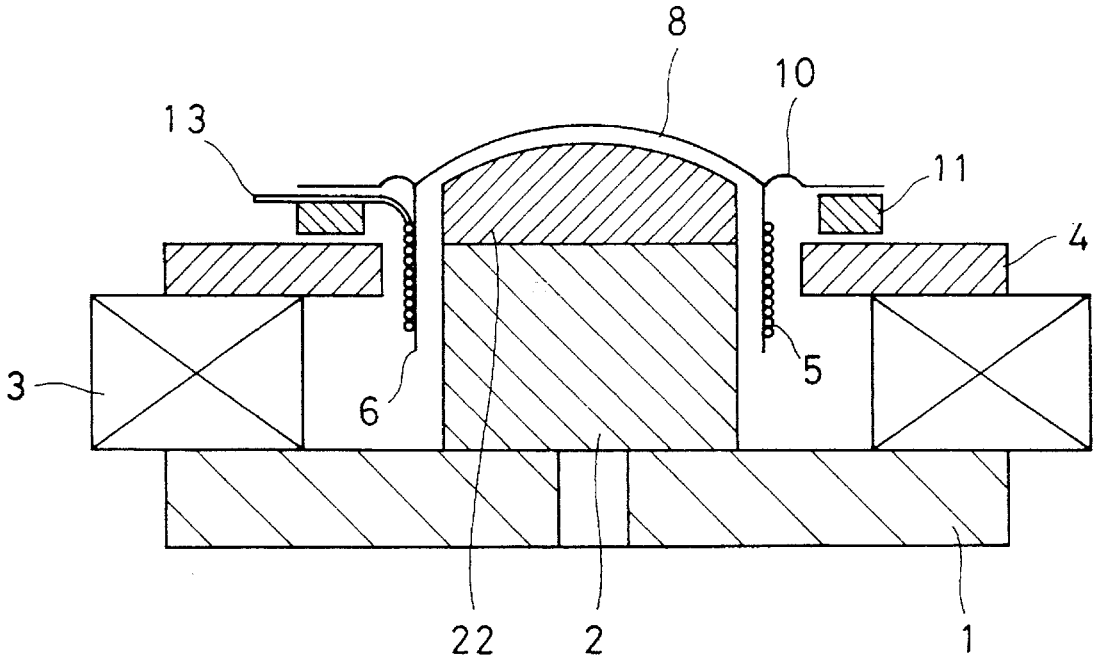
FIG. 3 is a sectional view showing a dome type loudspeaker.

By way of example, and not limitation, a comparative example of the present invention will now be given The following is a comparative example of the use of the dome-shaped diaphragm 8. The dome-shaped diaphragm 8 was formed through the heating-press process from ELA4110, and then an electro-dynamic dome-type tweeter with an absorbing member 22 was assembled as shown in FIG. 3 in which reference numerals denote the same members as shown in FIG. 1 respectively. Similarly, another tweeter was also assembled on the basis of a dome-shaped diaphragm of ELA4130. The properties of dome-shaped diaphragms of ELA4110 and ELA4130 were measured. The results is shown in Table 1 below. Table 1 includes some properties of comparative dome-shaped diaphragms of PI, PEI and PPS measured under the same conditions.

TABLE 1

| Diaphragm | Density ($kg/m^3$) | Young's modulus ($N/m^2$) | Internal loss |
|---|---|---|---|
| ELA4110 | $1.17 \times 10^3$ | $1.1 \times 10^8$ | 0.73 |
| ELA4130 | $1.23 \times 10^3$ | $5.3 \times 10^8$ | 0.44 |
| PI | $1.42 \times 10^3$ | $3.2 \times 10^9$ | 0.02 |
| PEI | $1.27 \times 10^3$ | $4.0 \times 10^9$ | 0.02 |
| PPS | $1.35 \times 10^3$ | $4.9 \times 10^9$ | 0.013 |

The polybutylene-terephthalate-polyester-elastomers of ELA4110 and ELA4130 have a melting point of 150 to 160 as a high heat-resistance and a tensile strength of 350 to 450 $kg/cm^2$ and further a high oil resistance.

Figure 4:
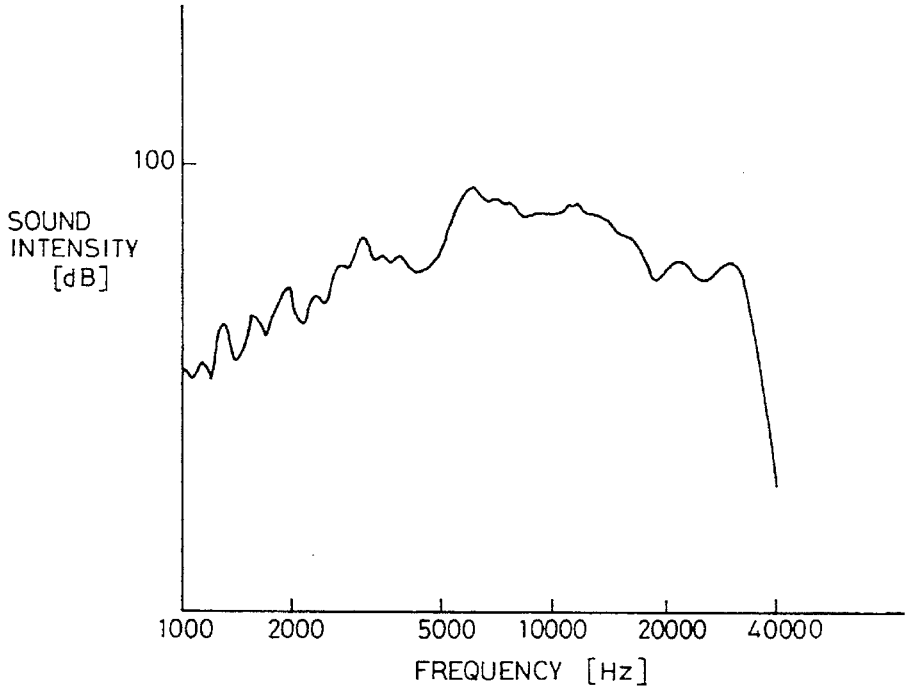
FIG. 4 is an audio spectrum property of a loudspeaker comprising a cone of an embodiment.
Figure 5:
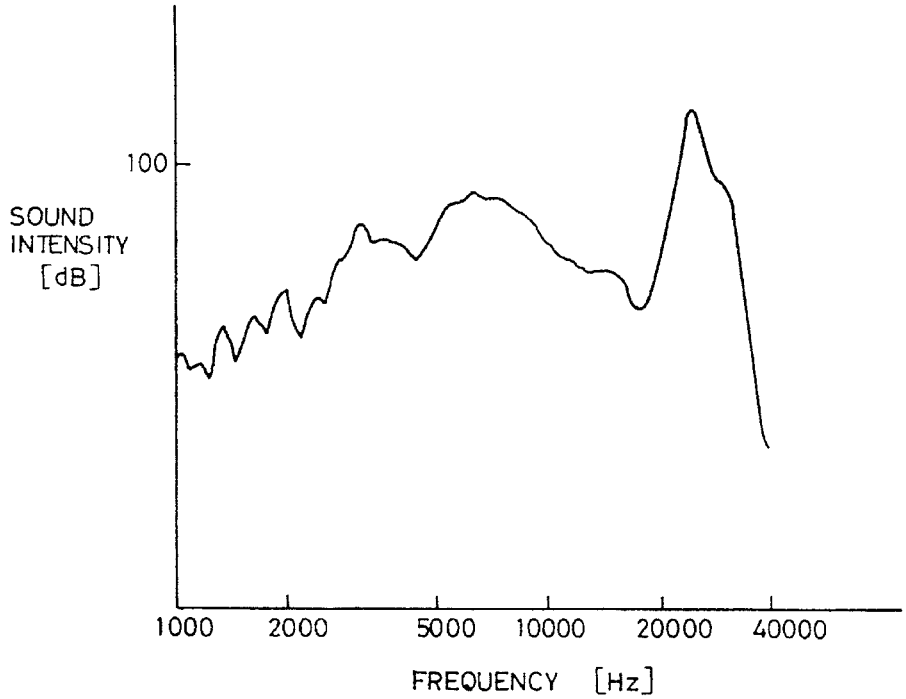
FIG. 5 is an audio spectrum property of a comparative loudspeaker comprising a cone made of PPS.

A electro-dynamic cone-type tweeter with the diaphragm of ELA4130 was assembled as a loudspeaker and then its audio spectrum property was measured. The result is shown in FIG. 4. FIG. 5 shows an audio spectrum property of a comparative cone-type tweeter comprising a diaphragm of PPS measured under the same conditions. It is understood from FIGS. 4 and 5 that there is no dip in the curve of the embodiment within 10 KHz to 20 KHz of the audio spectrum property in comparison with the comparative loudspeaker so that the embodiment have a flat audio spectrum property. Therefore, the diaphragm of polybutylene-terephthalate-polyester-elastomer is suitable for a mid-range and high-range loudspeaker.

It is an advantage of the present invention to provide a diaphragm of polybutylene-terephthalate-polyester-elastomer for a loudspeaker having a flat audio spectrum property and excellent in internal loss, heat-resistance, light-resistance and water-resistance.

What is claimed is:

1. A diaphragm used for a loudspeaker comprising polybutylene-terephthalate-polyester-elastomer represented by a formula below:

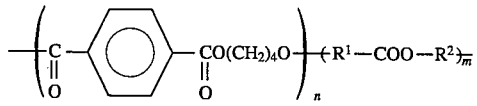

wherein $R^1$ is selected from the group consisting of $C_{17}H_{34}$, $C_{17}H_{32}$, $C_{17}H_{31}OCOCH_3$, and $Cl_5C_{17}H_{29}$, $R^2$ is selected from the group consisting of $C_4H_8$, $CH_2OCH_4H_6$, and $CH_2$, and n and m individually are integers.

* * * * *